US005658202A

United States Patent [19]

McGovern

[11] Patent Number: 5,658,202

[45] Date of Patent: Aug. 19, 1997

[54] POOL GAME TABLE

[76] Inventor: James Robert McGovern, E. 239th St., Bronx, N.Y. 10470

[21] Appl. No.: 623,745

[22] Filed: Mar. 29, 1996

[51] Int. Cl.[6] ..... A63D 15/00

[52] U.S. Cl. ..... 473/18

[58] Field of Search ..... 473/18, 19, 20

[56] References Cited

U.S. PATENT DOCUMENTS

| | | | |
|---|---|---|---|
| 1,669,822 | 5/1928 | Gregg | 473/18 |
| 3,801,097 | 4/1974 | Denei . | |
| 3,877,702 | 4/1975 | Saliger . | |
| 5,135,218 | 8/1992 | McGovern . | |

*Primary Examiner*—Theatrice Brown

[57] ABSTRACT

An improved circular pool table comprised of a flat surface rimmed by a ball rebound cushion comprised of a plurality of rubber tipped bumper segments, any one of which can be pivoted to an upright position to expose a segment pocket. Two brackets are superimposed on the table top. Each bracket carries an elongated cushion. The cushions are spaced apart and parallel. A new playing area shape is created where an equal number of segments are left uncovered at its ends. One bracket face displays a plurality of diagramed game plays, in frames. The other bracket face displays a plurality of score indicator units that correspond to the plays. Each segment has a graduated grooved plate fastened to its top surface. The invention supports a new game system. A player, following a diagram, launches a ball onto said playing area via said plate and then shoots to sink the game ball. The opponent must make the same diagramed play and shot. Awarded points are registered on said indicators. Points for missed shots are held in a jackpot and awarded in a playoff.

14 Claims, 5 Drawing Sheets

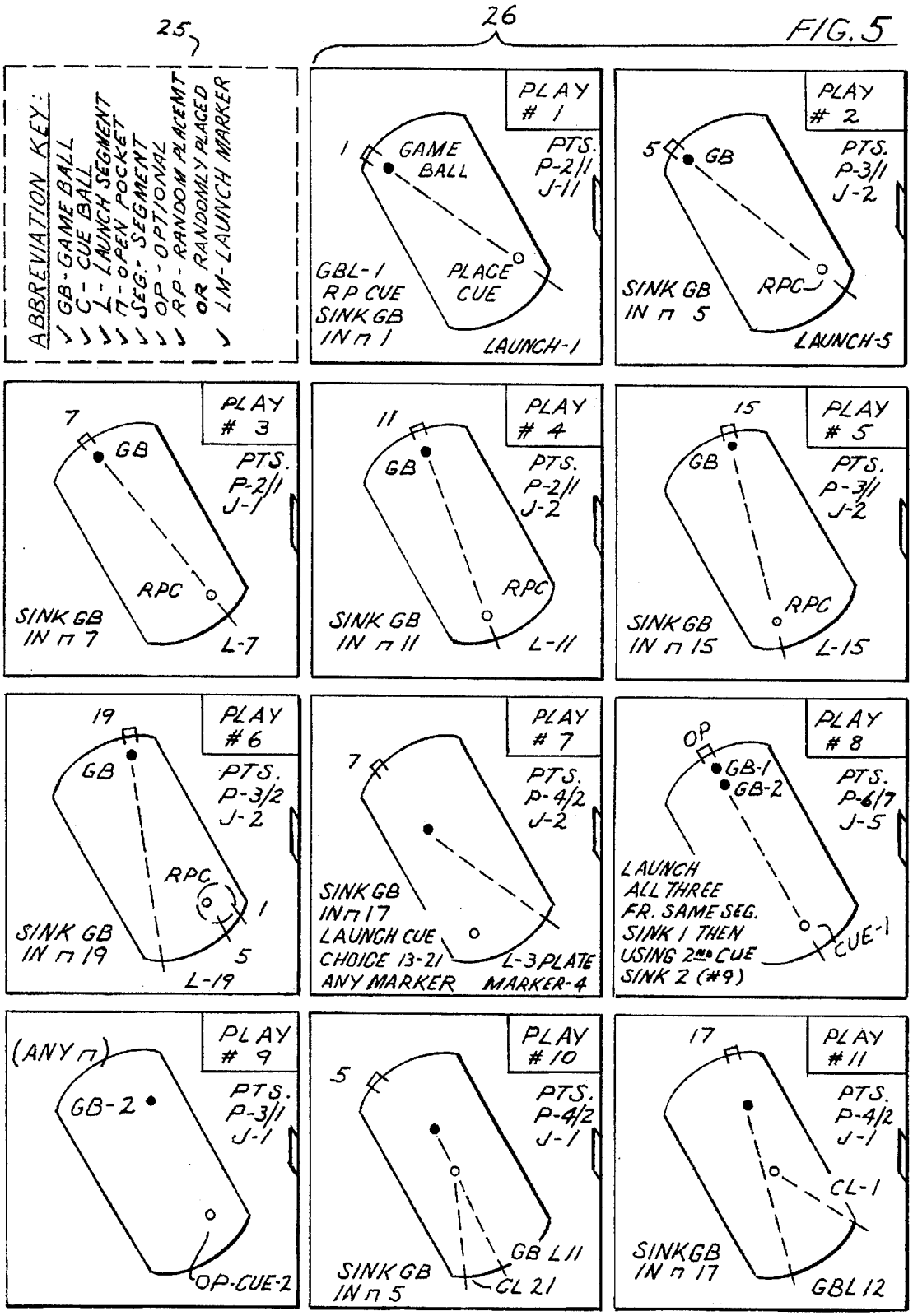
25
26
FIG. 5
ABBREVIATION KEY:
GB - GAME BALL
C - CUE BALL
L - LAUNCH SEGMENT
⊓ - OPEN POCKET
SEG. - SEGMENT
OP - OPTIONAL
RP - RANDOM PLACEMT
OR RANDOMLY PLACED
LM - LAUNCH MARKER
PLAY # 1
1
GAME BALL
PTS. P-2/1 J-1
GBL-1 RP CUE SINK GB IN ⊓ 1
PLACE CUE
LAUNCH-1
PLAY # 2
5
GB
PTS. P-3/1 J-2
SINK GB IN ⊓ 5
RPC
LAUNCH-5
PLAY # 3
7
GB
PTS. P-2/1 J-1
RPC
SINK GB IN ⊓ 7
L-7
PLAY # 4
11
GB
PTS. P-2/1 J-2
RPC
SINK GB IN ⊓ 11
L-11
PLAY # 5
15
GB
PTS. P-3/1 J-2
RPC
SINK GB IN ⊓ 15
L-15
PLAY # 6
19
GB
PTS. P-3/2 J-2
RPC
1
5
SINK GB IN ⊓ 19
L-19
PLAY # 7
7
PTS. P-4/2 J-2
SINK GB IN ⊓ 17 LAUNCH CUE CHOICE 13-21 ANY MARKER
L-3 PLATE MARKER-4
PLAY # 8
OP
GB-1
GB-2
PTS. P-6/7 J-5
LAUNCH ALL THREE FR. SAME SEG. SINK 1 THEN USING 2ND CUE SINK 2 (#9)
CUE-1
PLAY # 9
(ANY ⊓)
GB-2
PTS. P-3/1 J-1
OP-CUE-2
PLAY # 10
5
PTS. P-4/2 J-1
GB L11
SINK GB IN ⊓ 5
CL 21
PLAY # 11
17
PTS. P-4/2 J-1
CL-1
SINK GB IN ⊓ 17
GBL 12

POOL GAME TABLE

BACKGROUND OF THE INVENTION

This invention relates to billiard gaming devices but more specifically it relates to an apparatus that is used to play a new type of pool game.

The embodiment of the classic rectangular shaped pool table and the embodiment of the state of the art Round Pool Table support game systems that are interesting, but the games played on either table are slow and drawn out in character.

The present invention seeks to establish a game table that will be popular in pubs, neighborhood bars, and country inn's, because it will facilitate a rather rapidly completed pool game challenge The invention will provide apparatus that will transform the Round Pool Tables' embodiment into a new Pool Game Table embodiment, one that will support a novel new pool game system.

SUMMARY OF THE INVENTION

A primary object of the invention is to provide apparatus in the form of two large plastic cast brackets that can be superimposed, optionally, on the top of the round pool table in order to transform the tables embodiment. Imposition of the brackets will cause 21 segment/pockets to be exposed at each end or the new rectangular shaped playing area. Each bracket will carry an elongated bumper cushion. The cushions will be in parallel alignment. The brackets will be held by winged nuts and bolts so that they can be installed on and removed from the table, easily.

Another object of the invention is to provide apparatus in the form of slotted plates that have measured reference marks imprinted on them, where the plates are fastened to the inclined top surface of each segment so as to be able to estimate how far a game ball will roll when it is placed on the inclined fitting and released onto the table playing area surface.

Another object of the invention is to provide 21 diagramed plays that are identified by number and imprinted on cards that are displayed individually in frames on the face of a bumper cushion brackets. The plays are ranged from very simple to very difficult.

Another object of the invention is to provide 2 ball return tracks for the return of game balls by the players, from each end of the playing area. Said tracks to consist of an inclined groove with a ball holding area at its end.

Another object of the invention is to provide 3 large tally rings imprinted on the face of one of the bumper cushion brackets, that enclose 21 circle enclosed play-score indicators that are fastened to the face of the bracket.

There is one score indicator for each diagramed play. The indicator shows the number of points a play is worth. An indicator has four sliding shades that when actuated, identify who the points are awarded to, that is to player one, jackpot one, player two, or jackpot two.

Another object of the invention is to provide a write-on type of surface in the tally rings for calculating player totals and jackpot totals, to show who the winner is, and then erase what is written. Another object of the invention is to provide equipment in the form of game balls and game cue balls, where it is suggested that three green color game balls, and two white cue balls be available to one player, and three blue color game balls and two white cue balls be available to the other player, so that a game can proceed at a rapid pace.

Another object of the invention, in view of the round pool tables factor of multiple use, is to provide a supplimentary numbering system that applies only to the 21 segments that are left exposed at each end of the improved table so that these segments number identification is distinguishable from the number identification given these segments in U.S. Pat. No. 5,135,218.

These objects, and others not included, will be accomplished when the invention is constructed within the scope of the appended claims and in accordance with the accompanying drawings.

DESCRIPTION OF THE DRAWINGS

FIG. 5 is a plan view showing 11 of the invention's 21 suggested game play diagrams.

PREFERRED EMBODIMENT

Figure 1:
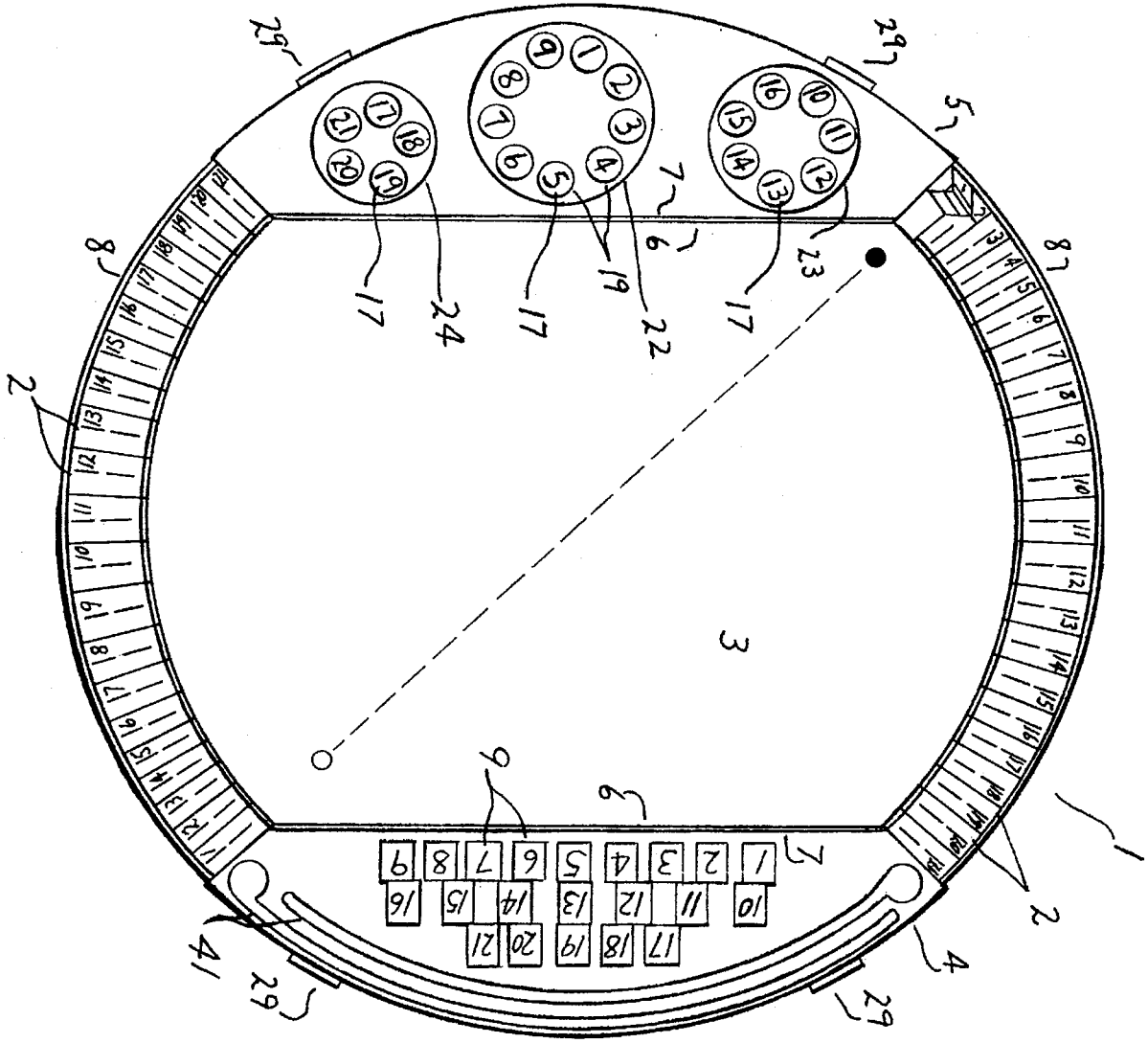
FIG. 1 is a plan view that shows the elements of the improvement of the round pool table.

Please refer to FIG. 1

Note 1. Equipment such as the suggested three green and three blue game balls, and four cue balls, referred to in the summary of the invention, and other equipment such as standard pool cues, while specified for use in the new invention, are not included in the drawings of the invention.

Continuing, in manufacture make a prototype of the present invention by providing a round pool table 1 such as is specified and claimed in U.S. Pat. No. 4,147,345.

Make the table with an outside diameter of 100 inches, with segments 2 that are about 8 inches in length, and with a playing area 3 of approximately 84 inches in diameter.

A table with an 84 inch diameter playing area 3 will yield an arrangement that provides 84 segments that are approximately 3.14 inches wide at the cushioned leading edge of each segment 2.

As show in FIG. 1, provide two brackets, one 4, to be superimposed over 21 segments 2 on the right side of the top of the table 1, and the other 5, to be superimposed over 21 segments 2 on the left side of the table 1. The brackets, 4 and 5, could be made of cast plastic. Provide each bracket with an elongated bumper cushion 6, fastened to its straight side 7. Fasten each bracket, 4 and 5, to the table skirt 8, as detailed below. This configuration of brackets will result in 21 segments 2 being exposed and playable at each end of the table's playing area 3.

Provide a supplementary number system for the exposed segments 2, marking each end's segments 1 to 21, proceeding in a clockwise direction.

Figure 2:
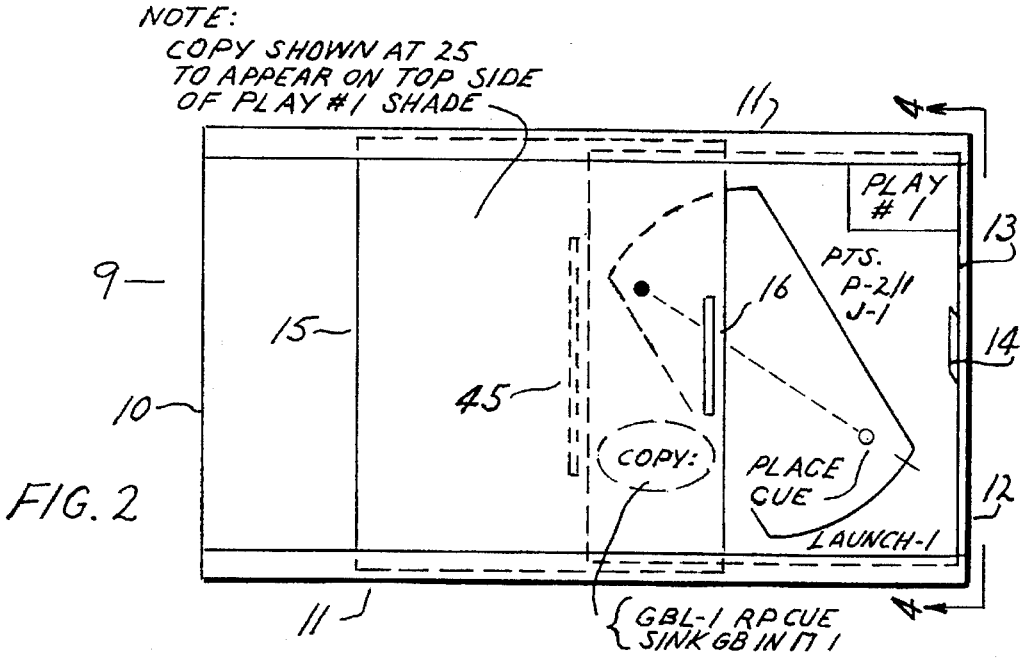
FIG. 2 is a perspective view of a typical game play point indicator ring unit.

Please refer to FIG. 2 and provide 21 game play diagram units with frames 10, in the approximate locations shown in FIG. 1.

Each frame 9 has a double channel 11 and 11 on both sides of a unit base 12. See FIG. 3 also.

Figure 3:
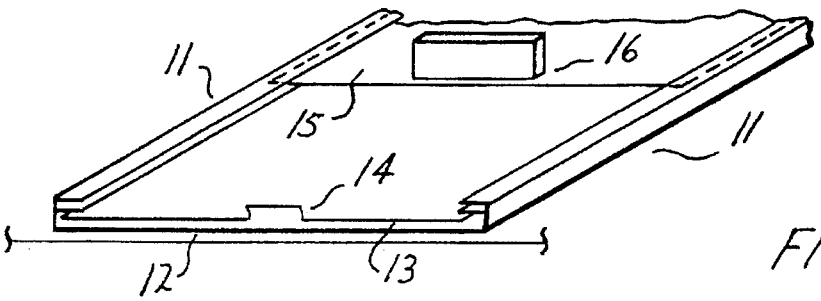
FIG. 3 is a top view of a game play diagram unit that shows a sliding shade that is moved horizontally to disclose the printed play diagram, printed on a detachable card.

A card 13 that displays a play diagram, play #1 is shown in FIG. 3, is slid into the bottom channels 10.

The card 13 has a tab like vertical grip 14 to facilitate grasp to move it horizontally. Ridge 25, on the top surface of unit base 12 limits the travel of the play diagram card.

A sliding shade 15 with a rectangular block like handle 16 is slid into the top channels 11. It functions to cover the diagramed play, and when moved horizontally, disclose the diagramed play.

Figure 4:
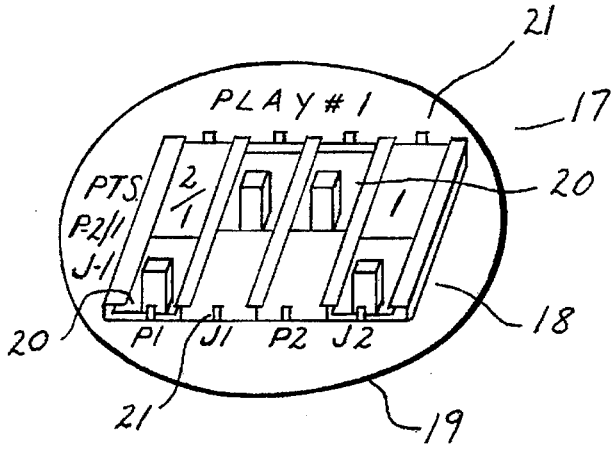
FIG. 4 is a perspective end view of a game play diagram unit.

Please refer to FIG. 4 and provide 21 score indicator units 17, with frames 18, in the approximate locations shown in FIG. 1.

The ring 19 around each unit 17 could be a decal. Each ring 19 displays the game play diagram unit play # the ring corresponds to. It also shows he point value associated with the play.

Each unit 17 has four shades 20 that can be moved horizontally to disclose the points awarded to P1 (player 1), J1 (Jacpot 1), P2 (Player 2), and J2 Jackpot 2).

The frame 18 of a 24 unit 17, could be glued to the ring 19.

Note that each shade's 20 travel is limited by a vertical standing tab 21 at both ends of the frame 18.

Provide 3 enlarged tally rings 22, 23, and 24, as enclosures of groups of score indicator units 17, as shown in FIG. 1.

Within each tally ring, 22, 23, and 24, provide a surface that can be written on, when calculating point totals, and then be erased.

Please refer to FIG. 5. The copy shown at 25, Abbreviation Key, is to appear on the top surface of the shade 15 that is provided for the game play diagram unit that displays game play #1. This is indicated in the note above FIG. 2.

At 26, 11 of 21 game play diagrams are illustrated. At 27, in FIG. 5A, the remaining 10 of the 21 game plays are shown.

Figure 5A:
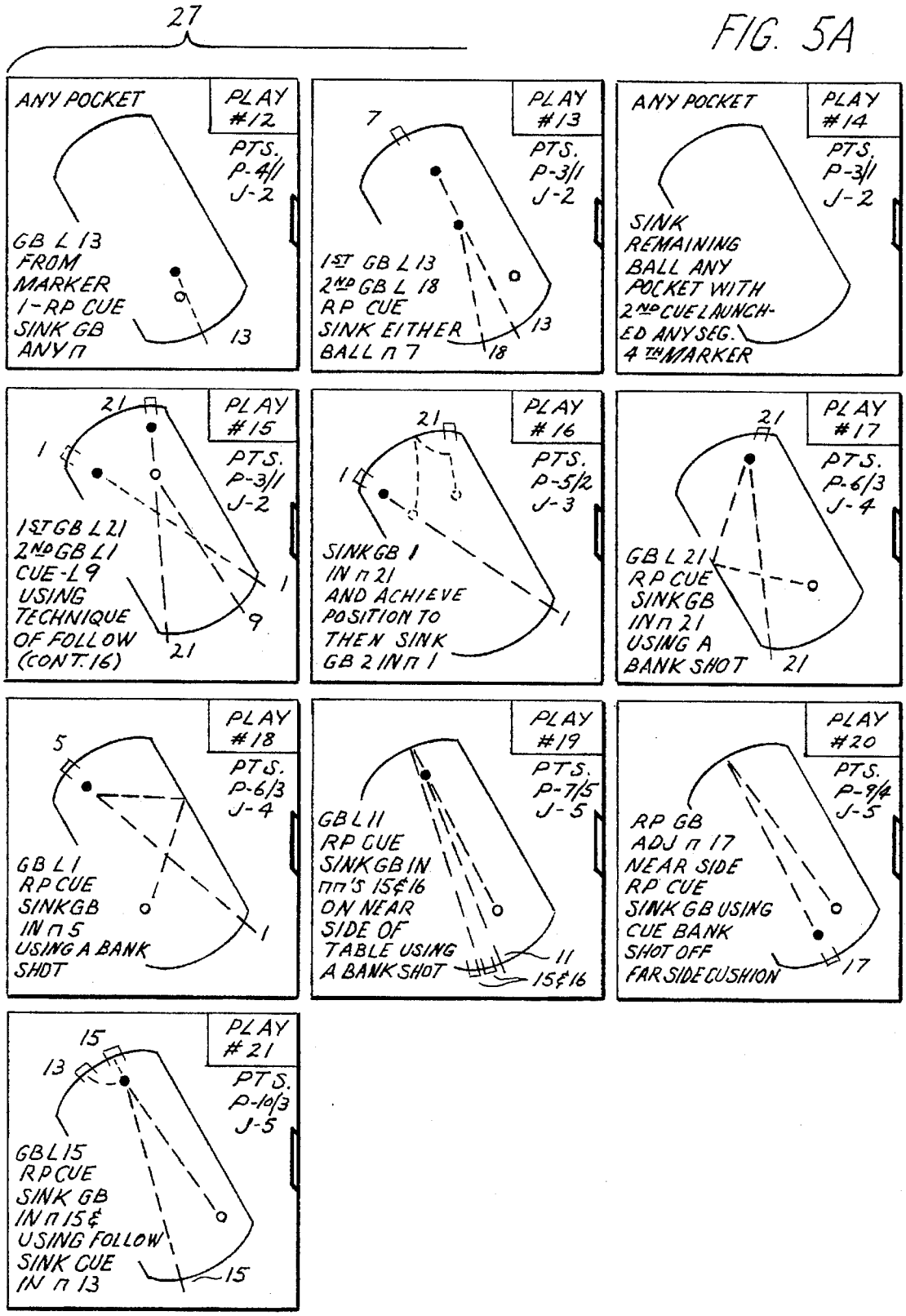
FIG. 5A is a plan view showing the remaining 10 of the invention's 21 suggested game play diagrams.

Each game play diagram in FIGS. 5 and 5A displays and identifies the play number, the point value awarded to a player or assigned to a Jackpot for the play, the game ball, the cue ball, the launch segment 2, the segment pocket used in the play, and a simulated track or pattern of suggested ball travel for the play.

Figure 6:
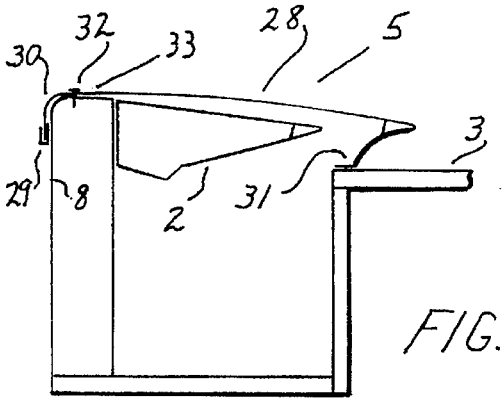
FIG. 6 is a section through line 6—6 of FIG. 1 that shows in elevation the attachment of a bracket casting to the top of the round pool table.
Figure 7:
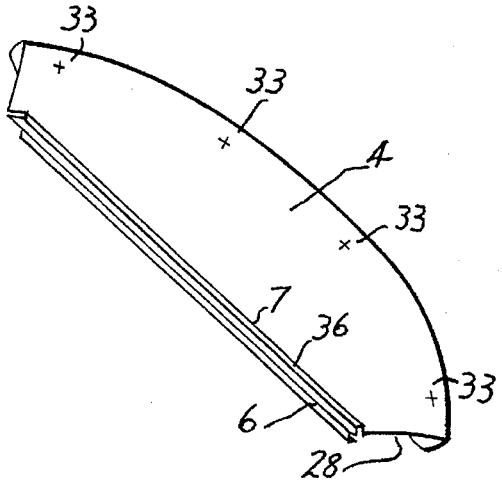
FIG. 7 is a perspective view of a bracket casting which shows additional bracket attachment points.

Note in FIG. 6, and FIG. 7, that brackets 4, and 5, are provided with curvature in their top member 28.

Provide two curved channel brackets 29 on each side of the table 1, to support the outboard side of each bracket, 4 and 5. Their 29 location is also shown in FIG. 1.

Fasten brackets 29 to the outer surface of the table skirt 8 with through bolts and nuts.

The curved vertical member 30 of each bracket, 4 and 5, sits in the two channels 29.

Along the underside of the leading edge of each bracket, 4 and 5, a horizontal foot 31 is provided to stabelize the bracket, 4 and 5, in its contact with the playing surface 3 of the table.

Each bracket, 4 and 5, is fastened to the table skirt 8 by four bolts with knurled nearly flat tops 32 at points 33 - FIG. 7, through holes in each bracket,4 and 5.

Figure 6A:
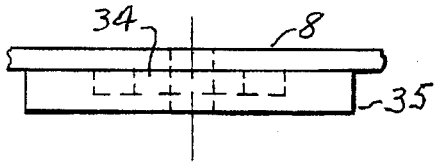

A hex nut 34 is provided for each bolt. Each nut is encased in a plastic block 35 that is glued to the underside of the skirt 8. See FIG. 6A. It is intended that when a bracket, 4 and 5, is superimposed on the top of the table 1 its movement will be stabelized by pressure at 29 and 31 when the bolts at 32 are hand tightened.

Continuing to refer to FIG. 7 provide a spacer strip 36 between the elongated bumper cushion 6 and the brackets, 4 and 5, straight side 7. The strip 36 is fastened to bracket side 7 by counter sunk sheet metal screws.

The bumper cushion 6 is glued by its grooved edge to the face of the spacer strip 36.

Figure 8:
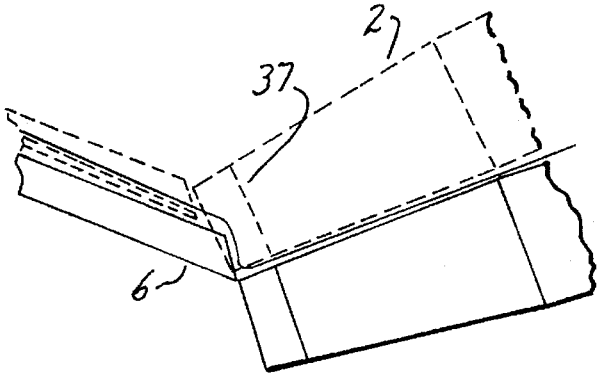
FIG. 8 is a top view of the intersection of a table segment's bumper cushion and a bracket's elongated straight bumper cushion.

Note in FIG. 8 that the intersecting end portion of a bracket bumper cushion 6 fits over the leading edge o the adjacent segment's bumper cushion 37.

The cushion 6 groove is shaped at the cushion's end, in manufacture to obtain a fit, between 6 and 37,as shown in FIG. 8.

Figure 9:
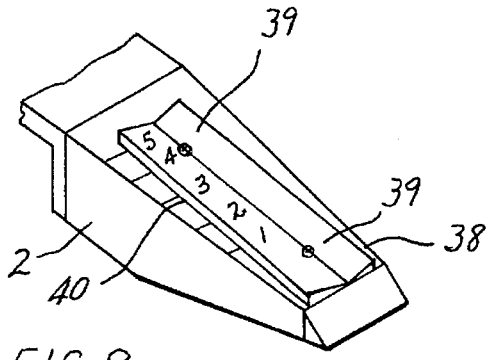
FIG. 9 is a perspective view of a grooved segment top ball launching plate.

With reference to FIG. 9 provide each of the new game table's 1 exposed, segments 2 with a grooved ball launch plate 38.

A plate 38 is narrower than the width of a segment 2.

The launch plate 38 could be fastened to the segment top with two counter sunk screws 39.

A ruled reference marker 40 is printed along the edge of each plate 38 on the top surface of the segment 2 it is mounted on.

Note that the leading edge of a plate 38 extends to the back edge of a segments bumper cushion 6.

Figure 10:
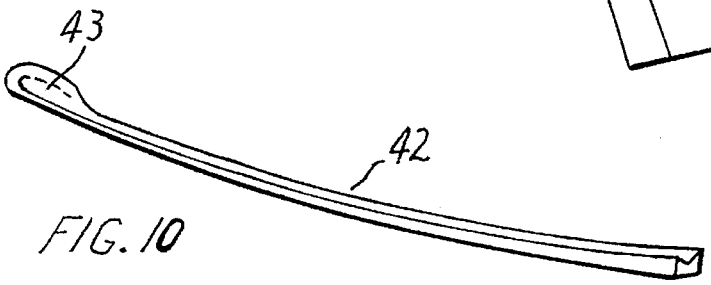
FIG. 10 is a perspective view of a ball return unit casting.

A ball return system 41 is shown in FIG. 1. The system 41 consists of two grooved, tapered, curved tracks 42 to facilitate the transfer of game balls or cue balls from opposite ends of the table's 1 playing area 3. See FIG. 10.

Each track 42 has a curved, recessed, ball containment area 43 at the tracks 42 low end.

A track 42 could be molded from plastic and glued to the face of bracket 4.

I claim:

1. An improved pool table comprising, a pool table having a circular playing surface, a vertically upstanding circular wall member completely encircling said playing surface, said wall member being spaced from the periphery of said playing surface to define an annular ball drop area therebetween, said ball drop area extending below the level of said playing surface; a plurality of arcuate bumper segments arranged around the entire periphery of said playing surface, said bumper segments being pivotally mounted to said wall member, each of said bumper segments being manually pivotable independently of each other from a horizontal position overlying said ball drop area and forming a ball rebound cushion to a vertical position to form a pocket with said ball drop area for a ball rolling on said playing surface, said bumper segments being functional to prevent a ball from being projected from said playing area into said ball drop area when all of said bumper segments are horizontal and further been functional to permit a ball to be projected into said ball drop area when any one of said bumper segments is disposed vertically;

in combination with the improvement of;

complementary game table bracket assemblies that each carry an elongated bumper cushion and are superimposed on said table's top, each completely covering a plurality of said table's segments to transform said table's round playing area into a near rectangular shaped playing area, and together providing equal pluralities of segment/pockets at each end of said near rectangular shaped playing area that are available for game play, a plurality of game play diagram units, where the frame of each unit carries a numbered diagramed play that is printed on a card, and a horizontally slideable shade that covers said play diagram and is a slid horizontally to disclose the diagramed play, where said units frames are fastened to the face of one a ball return asemblies, a ball return system comprised of two grooved, tapered, curved tracks disposed adjacent said play diagram units, and fastened to said bracket's face, so that they provide a means of transferring game balls or cue balls from either end of said playing area to the area's opposite end, a plurality of score indicator units, where the frame of each unit carries four horizontally slideable shades that cover game point amounts that can be awarded to player 1 or player 2, or assigned to Jackpot 1, or Jackpot 2, said points being printed on the top surface of said frames base, the awarding or assigning of said points being effected by moving said shades horizontally, and where said units frames are fastened to the face of said other bracket assembly; and a plurality of grooved ball launch plates, each fastened to the inclined top surface of each said playable segment/pocket, and each segment/pocket launch plate unit has a numbered scale printed on its face so that a player can estimate the travel distance a game ball will roll when it is placed on said plate and released onto said table's playing surface.

2. The pool table of claim 1, wherein said bracket assemblies each are stabelized and supported in their attachment to said round pool table by a pair of curved channel brackets that are fastened to and carried by said table's skirt.

3. The pool table of claim 1, wherein each said bracket assembly is stabelized by an elongated, flat, horizontal foot that extends near length of and is parallel to and beneath said bumper cushion, and that rests on and is pressed against the top surface of said table's playing surface.

4. The pool table of claim 1, wherein each said bracket assembly is positionally stabelized to the top of said round pool table by thumb tightened bolts, that are taken up by hex nuts, that are encased in plastic blocks, that are glued to the table skirt.

5. The pool table of claim 1, wherein said bracket assemblies are fastened to and removed from said round pool table by hand.

6. The pool table of claim 1, wherein said diagram units are each numbered consecutively, and are in a 1 to 1 correspondence.

7. The pool table of claim 1, wherein said plurality of segment/pockets at each end of said near rectangular playing area, is numbered consecutively, starting with the number 1.

8. The pool table of claim 1, wherein each card also displayed the number of game points that are awardede for the diagramed play printed on said card and the number of game points that are assigned for the diagramed play that is printed on said card.

9. The pool table of claim 1, wherein said diagramed cards are revisable and replaceable.

10. The pool table of claim 1, wherein said plays range from a very easy first play to a very difficult ending play.

11. The pool table of claim 1, wherein said indiator units are arranged and fastened to said bracket assembly in groups, so that a pool game could consist of the said entire plurality of plays, or of the plays in a given group.

12. The pool table of claim 1, wherein four cue balls are solid white, three game balls are another solid color, and three game balls are still another solid color.

13. The pool table of claim 1, wherein said game include the use of standard pool cues.

14. The pool table of claim 1, wherein said Jackpot 1 and Jackpot 2 game points constitute an end game dynamic.

* * * * *